US009975747B1

(12) United States Patent
Williams

(10) Patent No.: US 9,975,747 B1
(45) Date of Patent: May 22, 2018

(54) JACK WITH FLOATING PLATFORM

(71) Applicant: Bill J. Williams, Mission, TX (US)

(72) Inventor: Bill J. Williams, Mission, TX (US)

( * ) Notice: Subject to any disclaimer, the term of this patent is extended or adjusted under 35 U.S.C. 154(b) by 451 days.

(21) Appl. No.: 14/822,465

(22) Filed: Aug. 10, 2015

Related U.S. Application Data

(60) Provisional application No. 62/063,181, filed on Oct. 13, 2014.

(51) Int. Cl.
*B66F 3/35* (2006.01)
*B66F 3/24* (2006.01)
*B25H 1/00* (2006.01)

(52) U.S. Cl.
CPC ..... *B66F 3/35* (2013.01); *B25H 1/0007* (2013.01); *B66F 3/247* (2013.01)

(58) Field of Classification Search
CPC .. B66F 3/35; B66F 3/24; B66F 7/0625; B66F 7/065; B66F 7/26; F15B 15/10
See application file for complete search history.

(56) References Cited

U.S. PATENT DOCUMENTS 1,268,816 A 6/1918 Buchner et al.
1,745,959 A * 2/1930 Steiner ..... B66F 3/35 254/93 HP
2,495,092 A * 1/1950 Cox ..... B66F 3/35 188/154
2,804,118 A * 8/1957 Bayerkohler ..... B21D 1/08 187/210
3,015,470 A * 1/1962 Patchen ..... B66F 3/35 108/57.12
3,095,987 A * 7/1963 Sable ..... B61D 3/184 105/198.1
3,523,679 A * 8/1970 Clay ..... B66F 3/35 254/93 HP
3,565,398 A 2/1971 Floria et al.
3,695,582 A * 10/1972 Clay ..... B66F 3/35 254/93 HP
3,730,366 A * 5/1973 Berends ..... B60P 1/02 254/93 HP
3,730,481 A * 5/1973 Ekonen ..... B66F 3/247 254/93 R
3,843,092 A * 10/1974 Oehler ..... B60P 1/02 254/2 R
3,915,421 A * 10/1975 Le Forestier ..... B60N 2/02 248/631
4,087,895 A * 5/1978 Etienne ..... B60K 1/04 254/93 HP
4,323,141 A * 4/1982 Ragan ..... B66F 7/26 187/204
4,397,054 A * 8/1983 Lee, Jr. ..... B23G 1/22 254/93 HP (Continued)

*Primary Examiner* — Christopher M Koehler
*Assistant Examiner* — Seahee Yoon
(74) *Attorney, Agent, or Firm* — Aaron R. Cramer; Cramer Patent & Design, PLLC.

(57) ABSTRACT

A pneumatic jack includes at least a base platform and a top platform. The base platform is configured to be supported by a plurality of pneumatic jets. The pneumatic jets are configured to raise and lower the base platform and endow the apparatus with the ability to hover. An air bladder, with internal baffling, is positioned between a middle platform and the top platform. As the air bladder is inflated, the top platform rises relative to the other platforms.

20 Claims, 6 Drawing Sheets

(56) References Cited

U.S. PATENT DOCUMENTS

| | | | | | |
|---|---|---|---|---|---|
| 4,560,145 | A | | 12/1985 | Widmer | |
| 4,605,203 | A | * | 8/1986 | Hooper | B66F 3/35 254/93 H |
| 4,817,412 | A | * | 4/1989 | Hinson | B21D 1/14 254/93 HP |
| 5,096,160 | A | * | 3/1992 | Calico | B66F 7/065 254/122 |
| 5,542,500 | A | * | 8/1996 | Emrey | B62B 3/04 187/244 |
| 5,979,605 | A | * | 11/1999 | Popp | B66F 7/28 187/205 |
| 6,286,813 | B1 | | 9/2001 | Coccaro | |
| 6,926,256 | B2 | * | 8/2005 | Shah | B61K 5/04 254/89 H |
| 7,975,986 | B2 | * | 7/2011 | Bhachu | B66F 3/35 254/93 HP |
| 8,313,077 | B2 | * | 11/2012 | Rose | E21B 21/065 210/171 |
| 8,413,277 | B2 | | 4/2013 | Davis | |
| 8,413,960 | B2 | | 4/2013 | Davis | |
| 8,702,059 | B2 | | 4/2014 | Wieland | |
| 2008/0272351 | A1 | * | 11/2008 | Bhachu | B66F 3/35 254/93 R |
| 2009/0278098 | A1 | * | 11/2009 | Bacon | B66F 7/0625 254/1 |
| 2010/0264386 | A1 | * | 10/2010 | Dvorak | B66F 3/35 254/93 HP |
| 2015/0298265 | A1 | * | 10/2015 | Koch | B25B 5/061 228/213 |

* cited by examiner

JACK WITH FLOATING PLATFORM

RELATED APPLICATIONS

The present invention was first described in and claims the benefit of U.S. Provisional Application No. 62/063,181 filed Oct. 13, 2014, the entire disclosures of which are incorporated herein by reference.

FIELD OF THE INVENTION

The present invention relates generally to a jack includes a pneumatic base platform and a floating top platform attached to the base platform.

BACKGROUND OF THE INVENTION

As anyone who primarily engages in mechanical work will attest, nothing beats having the proper tool for a job. The proper tool can save time, save money, produce a higher quality job product, reduce damage to equipment, and provide for increased worker safety.

One (1) field where specialized tools are commonly utilized is in the field of automobile transmission repair. Often, repair of an automobile transmission requires that the transmission be entirely removed from the vehicle. In such instances, complete removal requires the transmission to be lowered out of the bottom of the vehicle using a jack. However, due to the weight and bulkiness of the transmission, complete removal is a difficult and time consuming process.

A transmission jack is normally used for such removal, but it is a generally "clunky" device that is limited in that it does not move upward, downward, or sideways with any degree of finesse. This often means one (1) or two (2) workers must manhandle the transmission in and out of place, thus increasing manpower, costs, and running the risk of physical injury. In some cases, the transmission may even slip and fall, damaging the transmission or injuring workers. The use of the jack allows a person repairing an automobile transmission to work on the same in a manner which is not only quick, easy, and effective, but perhaps most importantly, safe.

SUMMARY OF THE INVENTION

The inventor has recognized the aforementioned inherent problems and lack in the art and observed that there is a need for a jack with a floating platform.

It is therefore the purpose of the inventor to provide a jack which comprises a jack platform. The jack platform comprises an apron on an under side of the platform and a plurality of lift cylinders each having a cylinder end attached to an upper surface. The jack platform also comprises a cavity defined within the apron and a bottom surface of the jack platform; a manifold mounted to the jack platform; a first control valve block mounted to the jack platform capable of being in fluid communication with an air supply and the manifold; a second control valve block in fluid communication with the cylinder side of each of the plurality of lift cylinders; a plurality of air jets disposed through the jack platform in fluid communication between the manifold and the cavity; an intermediate platform mounted to a piston end of each of the plurality of lift cylinders; an air bladder, having a first end affixed to an upper surface of the intermediate platform and in fluid communication with the second control valve block; a plurality of guide posts, each having a first end attached to an upper surface of the intermediate platform; and, an object platform attached to a second end of the air bladder, opposite the first end, and to an upper end of each of the plurality of guide posts.

The first control valve block selectively delivers a first flow of air to the manifold and is delivered to the cavity causing each air jet to raise the jack. The first control valve block also selectively delivers a second flow of air to the second control valve block. The second control valve block selectively delivers a third flow of air to the cylinder side of each of the plurality of lift cylinders and delivers a fourth flow of air to the air bladder.

The apron is configured to be a projecting lip around the periphery of the jack platform. The object platform further comprises a pan having a concave depression formed into the pan's upper surface. The first control valve block comprises a pneumatic valve having a connection configured for fluid communication with the air supply and an internal cushion valve spool. The cushion valve spool is configured to direct the first flow of air into an air inlet of the manifold. The cushion valve spool is also operably controlled by a cushion valve actuator to position the cushion valve spool in a desired position. The cushion control valve actuator is also a positional lever.

The manifold comprises a hollow and convoluted domed structure. The plurality of air jets are each uni-directional. The first control valve block comprises an air hose. The plurality of lift cylinders are each single-acting. The second control valve block comprises a pneumatic control valve; an internal lift cylinder valve spool in fluid communication with the cylinder side of each of the plurality of lift cylinders; and, an air bladder valve spool in fluid communication with the air bladder.

The lift cylinder valve spool is controlled by a cylinder control valve actuator. The lift cylinder control valve actuator comprises a mechanical holding device to position the lift cylinder valve spool in a desired position. The cylinder control valve actuator is also a positional lever. The air bladder has a plurality of internal baffles and comprises a bladder inlet fitting located on a lower face of the intermediate platform and is in fluid communication with the second control valve block. The air bladder valve spool is controlled by an air bladder control valve actuator. The air bladder control valve actuator comprises a mechanical holding device to position the air bladder valve spool in a desired position. The air bladder control valve actuator is also a positional lever. The plurality of guide posts each comprises a longitudinally expanding cylinder having an external first post section secured to the intermediate platform and an internal sliding second post section which is secured to the object platform.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
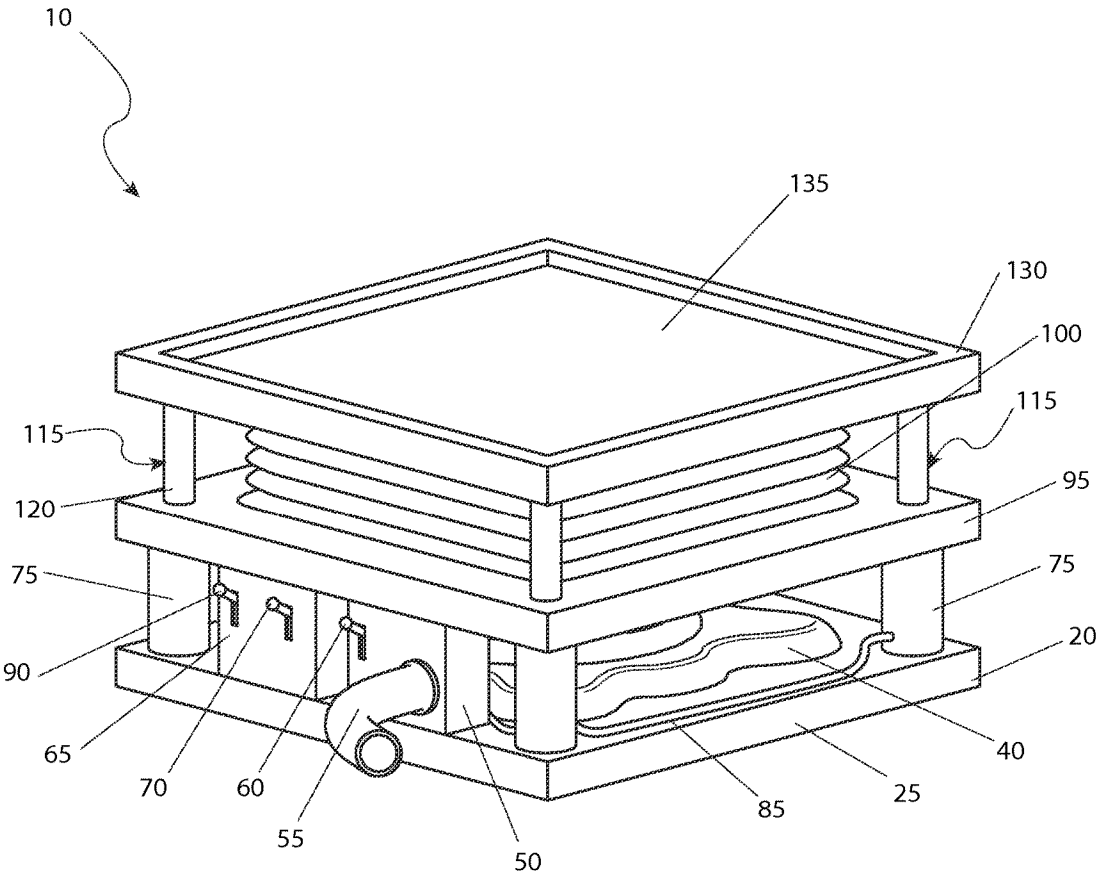
FIG. 1 is an isometric view of a pneumatic jack 10 with a floating jack platform 20 in accordance with the preferred embodiment of the present invention.

10 pneumatic jack
20 jack platform
25 apron
30 cavity
35 jet
40 manifold
45 air inlet
50 first control valve block
55 air hose
60 cushion control valve actuator
65 second control valve block
70 cylinder control valve actuator
75 lift cylinder
80 cylinder rod
85 air line
90 air bladder control valve actuator
95 intermediate platform
100 bladder
105 baffle
110 bladder fitting
115 guide post
120 first post section
125 second post section
130 object platform
135 pan
160 gap
175 cushion valve spool
180 lift cylinder spool
185 air bladder valve spool
200 support surface

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a pneumatic jack 10 with a floating jack platform 20 (herein referred to as the "apparatus"), which provides a means to elevate an object, such as a portion, or all, of some mechanical assembly, on a load platform 130 through some vertical distance with a combination of pneumatic lift cylinders 75 and a pneumatically inflated bladder 100 and then allow the movement of the apparatus 10, with the supported load, along a horizontal support surface 200 in two (2) unrestrained axes on a cushion of air accumulated under a jack platform 20. The load platform 130 is provided with an indented pan 135 configured to support the mechanical assembly.

Figure 2:
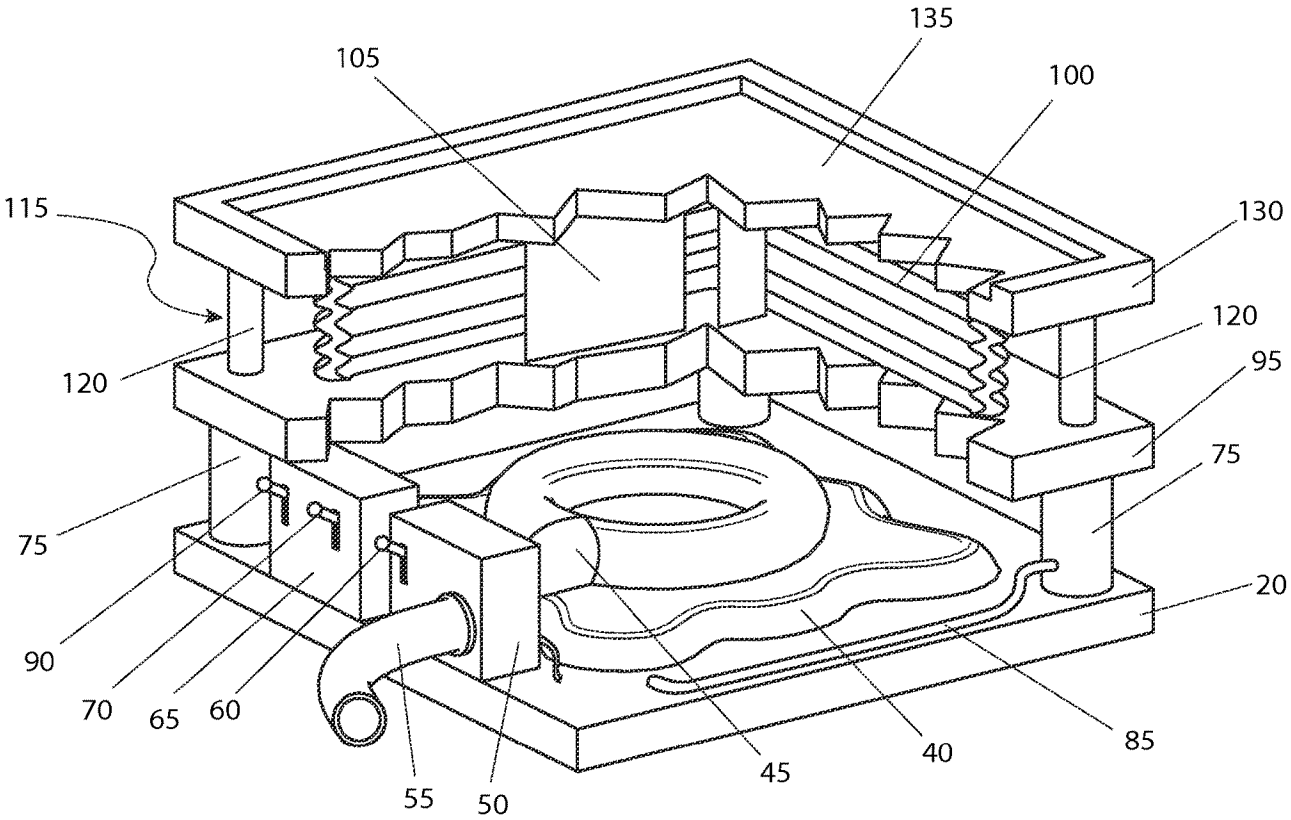
FIG. 2 is an isolated view of a manifold 40 of the pneumatic jack 10 in accordance with the preferred embodiment of the present invention.
Figure 3:
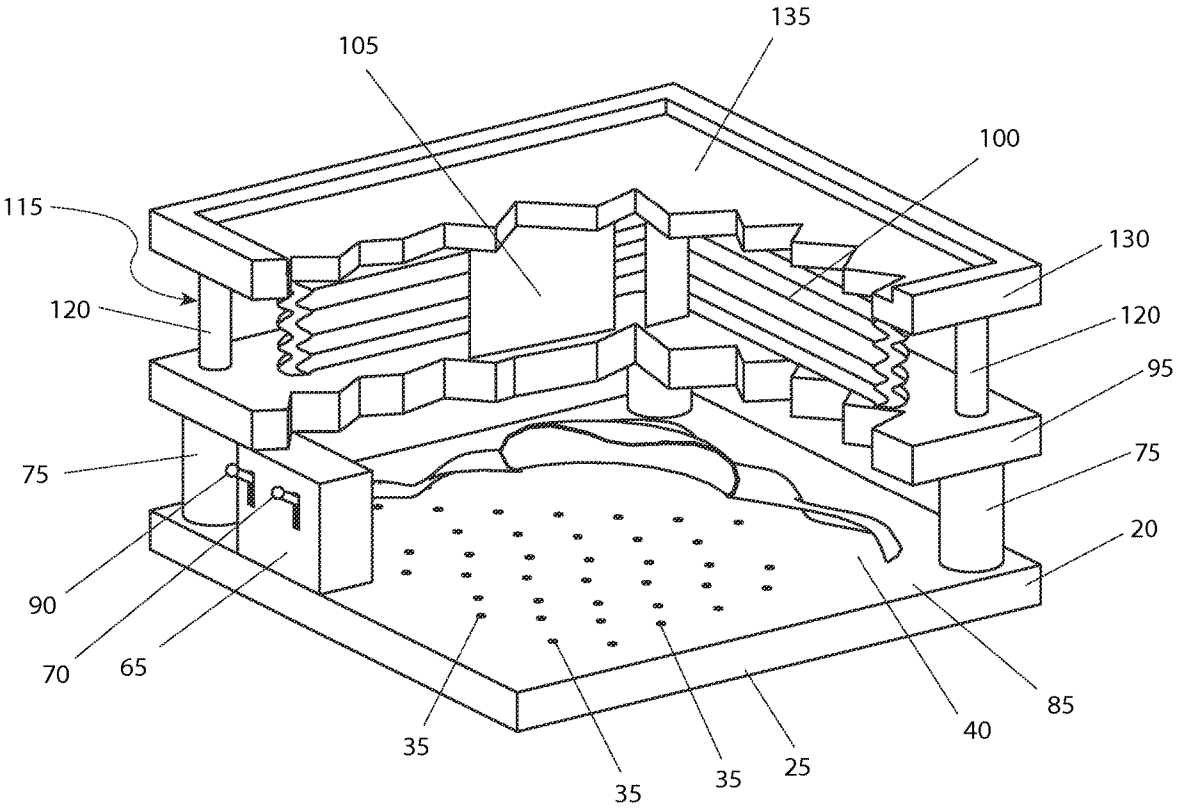
FIG. 3 is a breakaway view of the pneumatic jack 10 depicting a jet 35 in accordance with the preferred embodiment of the present invention.
Figure 4:
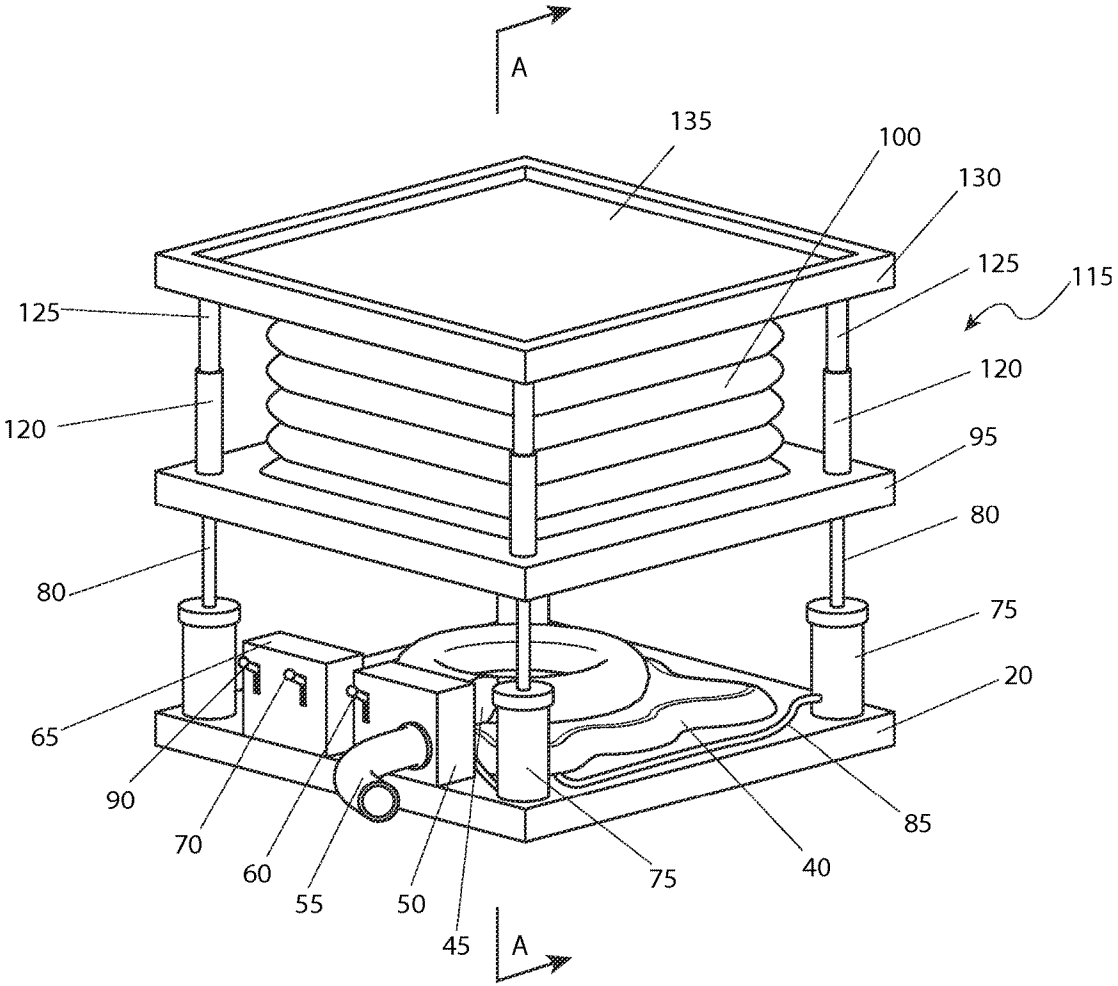
FIG. 4 is an isometric view of the pneumatic jack 10 in a vertically expanded configuration in accordance with the preferred embodiment of the present invention.
Figure 5:
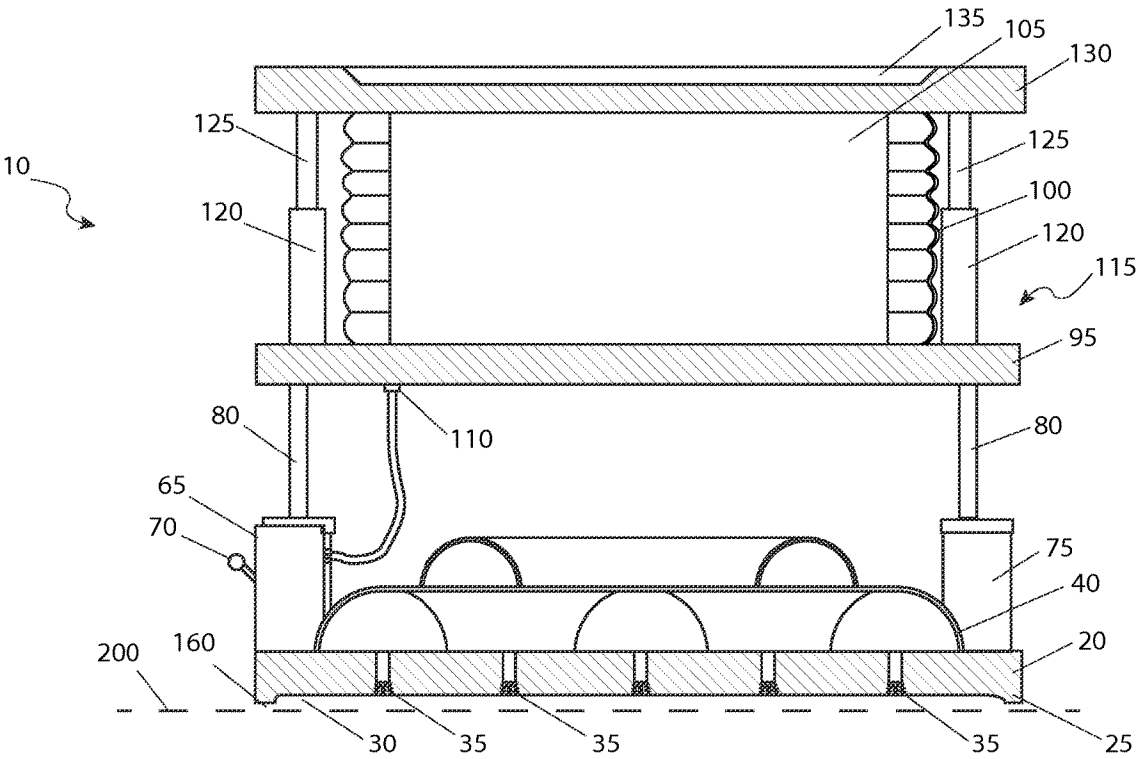
FIG. 5 is a section view along a line A-A as shown on FIG. 4 in accordance with the preferred embodiment of the present invention; and, FIG. 6 is a process flow diagram of the pneumatic jack 10 in accordance with the preferred embodiment of the present invention.
Figure 6:
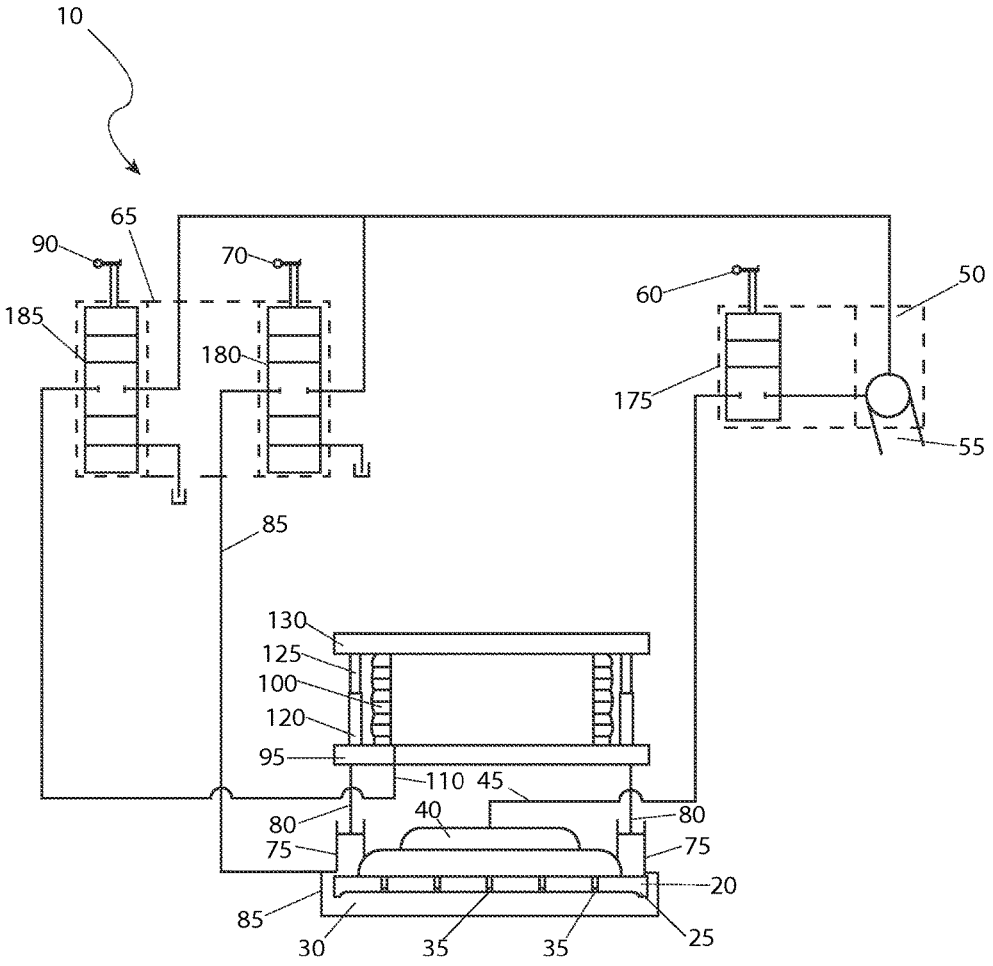

Referring now to FIG. 1, an isometric view of the apparatus 10 according to the preferred embodiment of the present invention, is disclosed. The apparatus 10 includes a jack platform 20 configured to be a square, or rectangular, polyhedron, preferably composed of a rigid thermoplastic, at the lowest of three (3) levels. It is understood that other materials, such as certain lightweight metals, may be utilized without limiting the scope of the apparatus 10. The jack platform 20 is provided with an apron 25 on an under side which is configured to be a projecting lip around the periphery of the jack platform 20. The encircling marginal apron 25, as illustrated in FIG. 5, forms a cavity 30 in which a supportive air cushion can be generated. Air supplied to the apparatus 10 via an air hose 55 into the first control valve block 50 is in communication with an air manifold 40. The air hose 55 may be a flexible tubular element. The first control valve block 50 is a commercially available pneumatic valve having a provision for the connection of an air supply and an internal cushion valve spool 175, as seen in FIG. 6, capable of directing air into an air inlet 45 of the manifold 40. The first control valve block 50 is mounted on the jack platform 20. The cushion valve spool 175 is controlled by a cushion control valve actuator 60 which is configured to be a positioning lever which permits a flow of air to the air inlet 45 in one (1) setting and blocks the flow of air to the air inlet 45 in another setting. The manifold 40, as shown in FIG. 2, is configured to be a hollow, convoluted, domed structure attached to the jack platform 20. Disposed within and through the jack platform 20, under the manifold 40, is a plurality of fixed, uni-directional air jets 35 as seen in FIG. 3.

The manifold 40 is utilized to supply air to all of the jets 35 simultaneously. Upon the activation of a cushion control valve actuator 60, air is permitted to flow through the air inlet 45 into the air manifold 40. The air inlet is a pipe, or tube, connecting the first control valve block 50 to the manifold 40. The flow of air progresses from the manifold 40 through the jets 35 into the apron 25 resulting in the accumulation of sufficient pneumatic pressure to cause the jack platform 20 to be raised. As the apron 30 is raised above a planar support surface 200, the air cushion will begin to be released. However, with a sufficient inflow of air, supplied through the manifold 40 and the jets 35, an equilibrium will be established wherein sufficient pneumatic pressure will be exerted inside the cavity 25 to maintain an elevation of the jack platform 20 above the support surface 200. The airflow through the gap 160 between the apron 30 and the support surface 200 will be balanced with the air supply so as to result in the apparatus 10 hovering above the support surface 200 on a near frictionless cushion of air.

Disposed upon the jack platform 20, in proximity to the corners thereof, is a plurality of lift cylinders 75. The lift cylinders 75 are commercially available pneumatic cylinders sized appropriately to provide sufficient force to elevate an intermediate platform 95, and any load bearing thereupon, up to an acceptable rated load. The lift cylinders 75 are preferably single-acting type cylinders which extend when activated and collapse due to the load exerted thereon when the air pressure is released. The piston side of the lift cylinders 75 is attached to the jack platform 20 while the cylinder rods 80 are attached to an underside of the intermediate platform 95. The lift cylinders 75 are in communication with a second control valve block 65. The second control valve block 65 is a commercially available pneumatic control valve having a provision to receive an air supply from the first control valve block 50 and an internal lift cylinder valve spool 180 and an air bladder valve spool 185, as schematically depicted in FIG. 6, capable of directing air flow, individually and selectively, to other destinations. The lift cylinder valve spool 180 is controlled by a cylinder control valve actuator 70. The cylinder control valve actuator 70 is a positioning lever for the lift cylinder valve spool 180 in communication with the lift cylinders 75. In one (1) setting, the lift cylinder valve spool 180 directs airflow to the lift cylinders 75 via the air lines 85. In a second setting, flow is blocked so that air can neither enter nor be exhausted from the lift cylinders 75. In a third position air is exhausted from the lift cylinders 75. The lift cylinder valve spool 180 may be equipped with mechanical holding devices such as centering springs or mechanical detents in order to preferentially position the control spool in any of the operational positions. The second control valve block 65 is mounted on the jack platform 20.

The intermediate platform 95 is configured to be a square, or rectangular, polyhedron, preferably composed of the same constituent material as the jack platform 20. Disposed upon an upper surface of the intermediate platform 95 is an expandable air bladder 100. The bladder 100 is preferably composed of a reinforced rubber compound, or other suitable polymer, capable of retaining a sufficient volume of air pressurized to the extent required to elevate the intended load on an object platform 130. The bladder 100 is generally square, or rectangular, with internal baffles 105. The baffles 105 are configured to be internal walls spanning the vertical distance between a lower and an upper face of the interior of the inflated bladder 100 in one (1) plane. The baffles 105 do not contact any side wall of the bladder 100 in any plane. The bladder 100 is attached to the upper surface of the intermediate platform 95 and to a lower face of the object platform 130 with a bladder inlet fitting 110 located on a lower face of the intermediate platform 95. The bladder inlet fitting 110 is connected to the second control valve block 65 for the supply and the exhaust of air. An air bladder control valve actuator 90, similar in construction to the other actuators 60, 70, is a positioning lever for the air bladder valve spool 185 in communication with the bladder 100, as illustrated in FIG. 6. In one (1) setting, the air bladder valve spool 185 directs airflow into the bladder 100 via the bladder inlet fitting 110 in order to elevate the object platform 130. In a second setting, flow is blocked so that air can neither enter nor be exhausted from the bladder 100. In a third position, air is exhausted from the bladder 100 to the atmosphere. The air bladder valve spool 185 may be equipped with mechanical holding devices such as centering springs or mechanical detents in order to preferentially position the control spool in any of the operational positions.

Disposed upon the intermediate platform 95, in proximity to the corners thereof, is a plurality of guide posts 115. The guide posts 115 are configured to be longitudinally expanding cylinders having an external first post section 120 attached to the intermediate platform 95 and an internal, sliding second post section 125 attached to the object platform 130. The guide posts 115 are intended to maintain a lateral alignment between the intermediate platform 95 and the object platform 130, especially during the expansion of the bladder 100 when there is a relative vertical motion. The first post section 120 and the second post section 125 are sized appropriately to provide sufficient stability to the elevating object platform 130 and any load bearing thereupon.

The object platform 130 is configured to be a square, or rectangular, polyhedron, preferably composed of the same constituent material as the jack platform 20 and the intermediate platform 95. Disposed upon an upper surface of the object platform 130 is a pan 135. The pan 135 is a concave depression formed into an upper surface of the object platform 130 intended to receive, and stabilize, a mechanical assembly which a user intends to be supported on the apparatus 10. The pan 135 may be provided with any pattern of additional ridges or embossment intended to improve the function or efficacy thereof.

The preferred embodiment of the present invention can be utilized by an enabled individual in a simple and straightforward manner with little or no training. After initial purchase or acquisition of the apparatus 10, it would be installed as indicated in FIG. 1. The method of installing and utilizing the apparatus 10 may be achieved by performing the following steps: acquiring a model of the apparatus 10 having a desired load rating to meet the needs of a user; attaching an air hose 55 of sufficient capacity to the first control valve block 50; connecting the air hose 55 to an appropriate supply of compressed air; manipulating the cushion control valve actuator 60 so as to move the cushion valve spool 175 to the energized position to supply a flow of air to the jets 35 thereby resulting in the apparatus 10 hovering above the support surface 200; maneuvering the apparatus 10, by any means possible, to the desired location to receive a selected mechanical assembly; moving the cushion valve spool 175 to the de-energized position, via the cushion control valve actuator 60, to halt the flow of air to the jets 35 thereby resulting in the apparatus 10 settling upon the support surface 200; and moving the lift cylinder valve spool 180 via the cylinder control valve actuator 70, or the air bladder valve spool 185 via the air bladder control valve actuator 90, as desired, to eventually elevate the object platform 130 to support the mechanical assembly in the pan 135. After the mechanical assembly is supported in the pan 135 of the object platform 130, the apparatus may be maneuvered to another location by moving the cushion valve spool 175 via the cushion control valve actuator 60 to the energized position as before, to supply a flow of air to the jets 35 thereby resulting in the apparatus 10 hovering above the support surface 200.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A jack, comprising:

a jack platform, comprising an apron on an under side thereof and a plurality of lift cylinders each having a cylinder end attached to an upper surface thereof;

a cavity defined within said apron and a bottom surface of said jack platform;

a manifold mounted to said jack platform;

a first control valve block mounted to said jack platform capable of being in fluid communication with an air supply and said manifold;

a second control valve block in fluid communication with said cylinder side of each of said plurality of lift cylinders;

a plurality of air jets disposed through said jack platform in fluid communication between said manifold and said cavity;

an intermediate platform mounted to a piston end of each of said plurality of lift cylinders;

an air bladder, having a first end affixed to an upper surface of said intermediate platform and in fluid communication with said second control valve block;

a plurality of guide posts, each having a first end attached to the upper surface of said intermediate platform; and, an object platform attached to a second end of said air bladder, opposite said first end, and to an upper end of each of said plurality of guide posts;

wherein said first control valve block selectively delivers a first flow of air to said manifold;

wherein said first flow of air is delivered to said cavity causing each air jet to raise said jack;

wherein said first control valve block selectively delivers a second flow of air to said second control valve block;

wherein said second control valve block selectively delivers a third flow of air to said cylinder side of each of said plurality of lift cylinders; and, wherein said second control valve block selectively delivers a fourth flow of air to said air bladder.

2. The jack of claim 1, wherein said apron is configured to be a projecting lip around the periphery of said jack platform.

3. The jack of claim 1, wherein said object platform further comprises a pan comprising a concave depression formed into an upper surface thereof.

4. The jack of claim 1, wherein said first control valve block comprises a pneumatic valve having a connection configured for fluid communication with said air supply and an internal cushion valve spool;

wherein said cushion valve spool is configured to direct said first flow of air into an air inlet of said manifold.

5. The jack of claim 4, wherein said cushion valve spool is operably controlled by a cushion valve actuator to position said cushion valve spool in a desired position.

6. The jack of claim 5, wherein said cushion control valve actuator is a positional lever.

7. The jack of claim 1, wherein said manifold comprises a hollow, convoluted, domed structure.

8. The jack of claim 1, wherein said plurality of air jets are each uni-directional.

9. The jack of claim 4, wherein said first control valve block comprises an air hose.

10. The jack of claim 1, wherein said plurality of lift cylinders are each a single-acting lift cylinder.

11. The jack of claim 1, wherein said second control valve block comprises:

a pneumatic control valve;

an internal lift cylinder valve spool in fluid communication with said cylinder side of each of said plurality of lift cylinders; and, an air bladder valve spool in fluid communication with said air bladder.

12. The jack of claim 11, wherein said lift cylinder valve spool is controlled by a cylinder control valve actuator.

13. The jack of claim 12, wherein said lift cylinder control valve actuator comprises a mechanical holding device to position said lift cylinder valve spool in a desired position.

14. The jack of claim 13, wherein said cylinder control valve actuator is a positional lever.

15. The jack of claim 1, wherein said air bladder has a plurality of internal baffles.

16. The jack of claim 1, wherein said air bladder comprises a bladder inlet fitting located on a lower face of said intermediate platform and in fluid communication with said second control valve block.

17. The jack of claim 11, wherein said air bladder valve spool is controlled by an air bladder control valve actuator.

18. The jack of claim 17, wherein said air bladder control valve actuator comprises a mechanical holding device to position said air bladder valve spool in a desired position.

19. The jack of claim 18, wherein said air bladder control valve actuator is a positional lever.

20. The jack of claim 1, wherein said plurality of guide posts each comprises a longitudinally expanding cylinder having an external first post section secured to said intermediate platform and an internal, sliding second post section secured to said object platform.

* * * * *